US010051958B2

(12) United States Patent
Andersson et al.

(10) Patent No.: US 10,051,958 B2
(45) Date of Patent: Aug. 21, 2018

(54) FASTENING PART OF A STORAGE SYSTEM

(71) Applicant: Elfa International AB, Vastervik (SE)

(72) Inventors: Johan Andersson, Vastervik (SE); Peter Nilsson, Vastervik (SE)

(73) Assignee: Elfa International AB, Vastervik (SE)

( * ) Notice: Subject to any disclaimer, the term of this patent is extended or adjusted under 35 U.S.C. 154(b) by 0 days.

(21) Appl. No.: 15/318,341

(22) PCT Filed: Jun. 8, 2015

(86) PCT No.: PCT/EP2015/062692
§ 371 (c)(1),
(2) Date: Dec. 12, 2016

(87) PCT Pub. No.: WO2015/189142
PCT Pub. Date: Dec. 17, 2015

(65) Prior Publication Data

US 2017/0119150 A1 May 4, 2017

(30) Foreign Application Priority Data

Jun. 11, 2014 (EP) ..... 14171896

(51) Int. Cl.
*A47F 5/00* (2006.01)
*A47B 57/40* (2006.01)
(Continued)

(52) U.S. Cl.
CPC ..... *A47B 57/406* (2013.01); *A47B 61/04* (2013.01); *A47B 96/068* (2013.01)

(58) Field of Classification Search
CPC .... A47F 5/0823; A47F 5/0815; A47F 5/0846; A47F 5/0807; A47F 5/0861; A47F 5/0869
(Continued)

(56) References Cited

U.S. PATENT DOCUMENTS 3,988,808 A 11/1976 Poe et al.
4,697,774 A 10/1987 Sarton et al.
(Continued)

FOREIGN PATENT DOCUMENTS

CN 2691987 4/2005
TW 569992 U 1/2004
(Continued)

OTHER PUBLICATIONS

Search Report received in Taiwanese Application No. 103128884, dated Mar. 3, 2016, 1 page.
(Continued)

*Primary Examiner* — Steven M Marsh
(74) *Attorney, Agent, or Firm* — Hubbard Johnston, PLLC

(57) ABSTRACT

The present disclosure relates to a fastening part for a storage system. The system comprises a storage device, such as a basket, a set of hooks, a shoe rack, a perforated panel or the like, which can be attached, by means of the fastening part, to a carrier element with a number of slots. The fastening part comprises a base portion, with at least one opening, an inner part, resting on the base portion at the carrier element's side and providing at least one hook to be inserted into the carrier element, and another part resting on the base portion at an outer side, and comprising a connector that engages with the inner part through said at least one opening, such that the base portion is sandwiched between the inner part and the outer part.

25 Claims, 4 Drawing Sheets

(51) Int. Cl.
*A47B 61/04* (2006.01)
*A47B 96/06* (2006.01)

(58) Field of Classification Search
USPC ..... 248/220.41, 220.42, 220.43, 220.31; 211/87.01
See application file for complete search history.

(56) References Cited

U.S. PATENT DOCUMENTS

| | | | | |
|---|---|---|---|---|
| 6,070,747 | A * | 6/2000 | Shea | A47F 5/0807 211/103 |
| 6,722,619 | B2 * | 4/2004 | Valiulis | A47F 5/0823 248/220.31 |
| 6,866,154 | B2 * | 3/2005 | Hartman | G06F 1/183 211/191 |
| 7,404,533 | B1 * | 7/2008 | Kologe | A47F 5/0838 248/220.22 |
| 2008/0169255 | A1 | 7/2008 | Kokenge et al. | |
| 2010/0300999 | A1 * | 12/2010 | Schwartzkopf | A47B 96/061 211/104 |

FOREIGN PATENT DOCUMENTS

| | | | |
|---|---|---|---|
| TW | M397939 | U | 2/2011 |
| TW | M405398 | U | 6/2011 |
| WO | 2004112541 | A1 | 12/2004 |

OTHER PUBLICATIONS

International Search Report and Written Opinion received in Patent Cooperation Treaty Application No. PCT/EP2015/062692, dated Aug. 6, 2015, 9 pages.

* cited by examiner

SECTION A-A

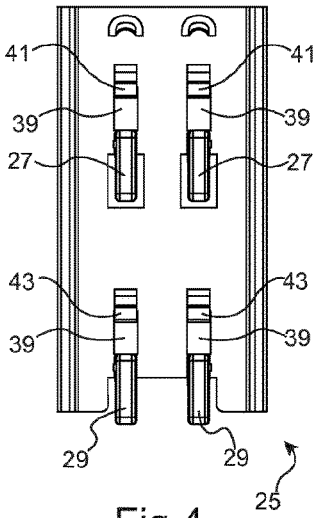
Fig 4
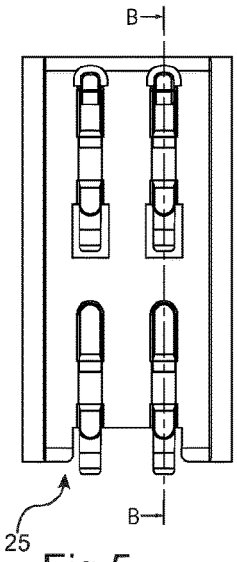
Fig 5
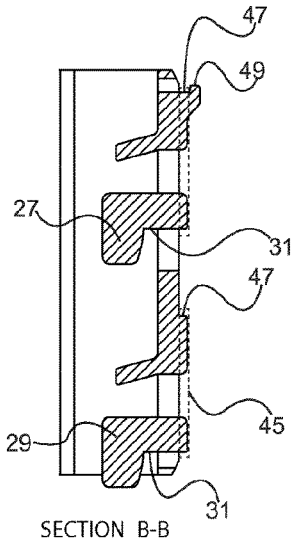
Fig 6
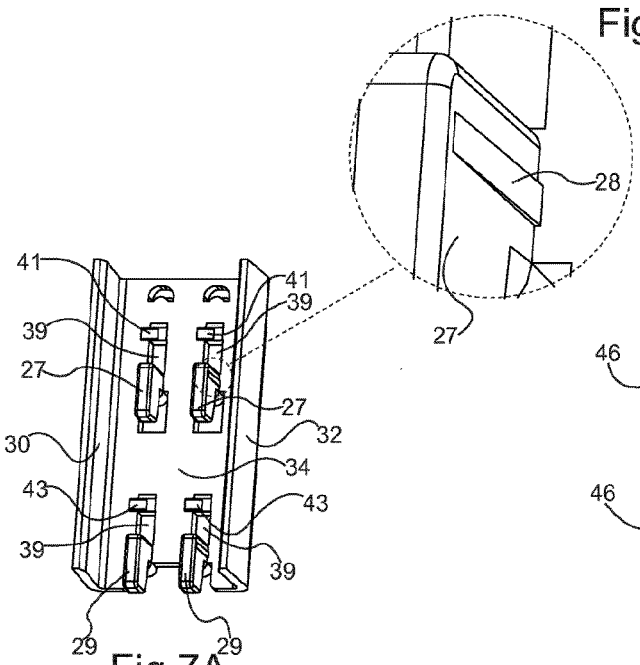
Fig 7B
Fig 7A
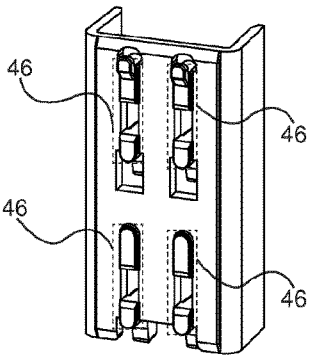
Fig 8

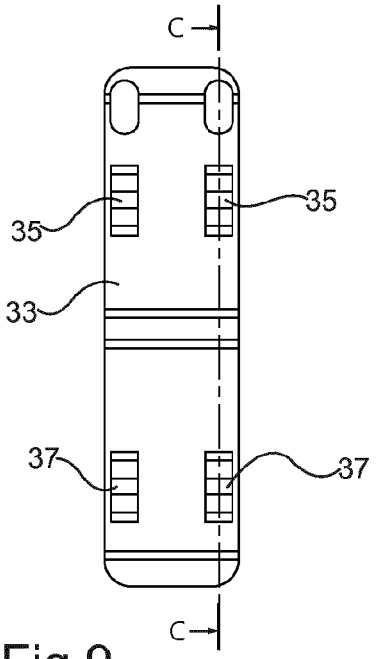
Fig 9
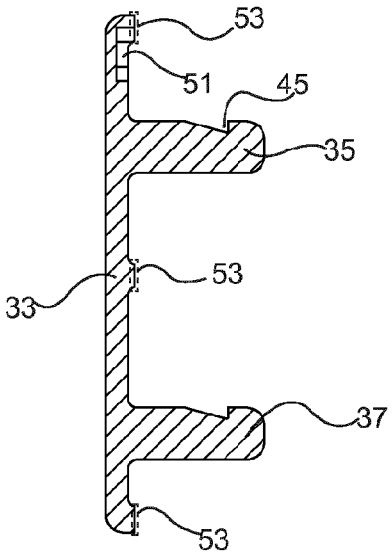
Fig 10 SECTION C-C
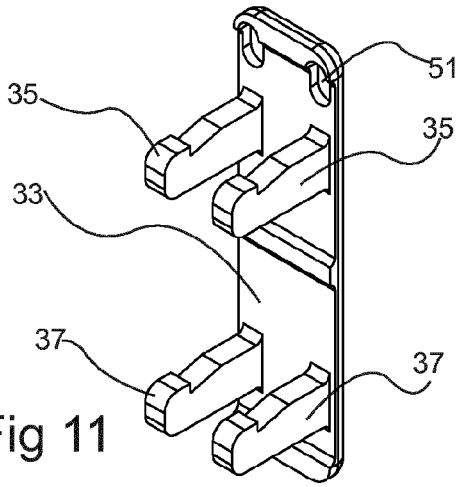
Fig 11

FASTENING PART OF A STORAGE SYSTEM

RELATED APPLICATION

This application, a national phase application of PCT/EP2015/062692, filed Jun. 8, 2015 claims priority to European Application No. 14171896.5 filed Jun. 11, 2014.

TECHNICAL FIELD

The present disclosure relates to a fastening part for a storage system, the fastening part being attached to a storage device, such as a basket, a set of hooks, a shoe rack, a perforated panel or the like, and being adapted to be attached, at a carrier side, to a vertical carrier element with a number of slots, wherein the fastening device comprises base portion, and at least one hook extending from the base portion at the carrier side and being intended to be inserted into one such slot.

BACKGROUND

Such a fastening device is disclosed in WO-2004/112541-A1. That fastening device has a base portion with leg portions formed by bending a metal sheet into U-shape and with hook elements formed in the base portion by being punched out therefrom. The fastening device can be integrated in e.g. a basket. The hook elements cannot be thicker than the base portion itself, and can be deformed if subjected to careless use or excessive wear. This can make the attachment to the carrier element rather loose. Also, forming hooks from punching can be a rather complicated operation.

SUMMARY

One object of the present disclosure is therefore to provide a more reliable fastening part that can be produced at a low cost. This object is achieved by means of a fastening part as defined in claim 1. More specifically, a fastening part of the initially mentioned kind then includes at least one opening in the base portion. Further, an inner part, resting on the base portion at said carrier side, is provided, which comprises the at least one hook, and an outer part, resting on the base portion at an outer side, and comprising a connector that engages with said inner part through said at least one opening, such that the base portion is sandwiched between the inner part and the outer part.

With this configuration, more reliable hook elements can be provided and can be attached to the base portion by connecting the outer part with the inner part.

Leg portions may extend towards the carrier side from a mid section of the inner part, such that the fastening device has a U-shaped cross section, which may straddle a U-shaped carrier element when attached thereto. This provides a more stable connection.

One form of storage device is a slotted plate comprising a number of slots. The base portion may then be integrated in one piece with said plate. Edges of the plate may be flanged towards the carrier side of the fastening device, and at least in the vicinity of the fastening device, the flanges may comprise a notch, such that a carrier element can be accommodated in the notch.

Alternatively, the storage device may be a box or basket and may be provided with a fastening device that is inserted inside the outer periphery of the box or basket.

The outside of the inner part may comprise projections that extend, from the inner part, such that they can enter the openings of the base portion. These projections may include a ledge, on which the upper edge of a base part opening can rest, and an outer hook that reaches out to the storage device side of the base part. This allows the fastening part to carry a greater load.

A connector of the outer part may include a recess, and the inner part may comprise a tongue adapted to snap into said recess in order to keep the inner and outer parts locked together.

Typically, the inner part may comprise an upper and a lower pair of hooks for connecting to a carrier element.

The inner and outer parts may be made in injection moulded plastic.

BRIEF DESCRIPTION OF THE DRAWINGS

FIG. 4 shows a front view of an inner part as seen from the carrier side.

FIG. 5 shows a front view of an inner part as seen from the storage device side.

FIG. 6 shows a cross section along the line B-B in FIG. 5.

FIG. 7A shows a perspective view of an inner part as seen from the carrier's side.

FIG. 7B shows an enlarged portion of FIG. 7A.

FIG. 8 shows a perspective view of an inner part as seen from the storage device's side.

FIG. 9 shows a front view of an outer part as seen from the carrier side.

FIG. 10 shows a cross section along the line C-C in FIG. 9.

FIG. 11 shows a perspective view of an outer part as seen from the carrier side.

DETAILED DESCRIPTION

The present disclosure relates to a fastening device for a storage system that is intended for storing different objects suspended from a door, a wall or similar. WO-2004/112541-A1 shows such a system comprising a carrier element having a number of slots or through holes. The carrier element is intended to be mounted, vertically orientated, on a door, a wall or similar. A basket, a set of hooks, a shoe rack or the like is provided with a fastening device for detachable suspension from the carrier element. Such systems may be very useful for instance in workplaces and residences where storage space is restricted. A carrier element may be attached e.g. on a wall or on the inside of a cupboard door, and a number of baskets and hook sets may be releasably attached to the carrier element.

Figure 1:
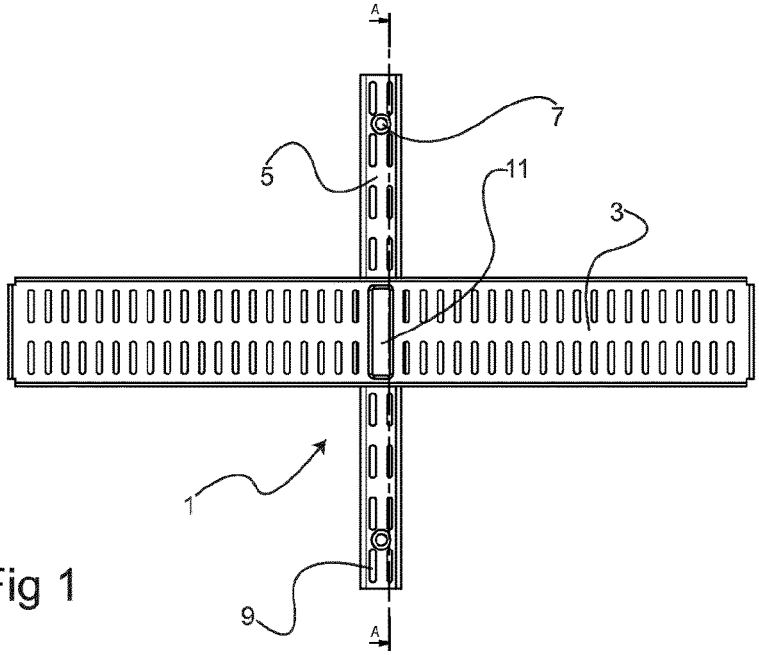
FIG. 1 shows a front view of a combination with a storage device attached to a carrier element.

FIG. 1 shows a front view of a combination 1 with a storage device 3 attached to a carrier element 5. The carrier element 5, which is well known per se, is intended to be vertically attached e.g. to a wall, for instance by applying screws through screw holes 7 in the element. The carrier element 5 can be formed by bending a sheet metal plate into a U-shaped cross section, and has two parallel rows of elongated openings or slots 9 arranged in pairs in the centre portion of the 'U'. The storage device can be suspended from the carrier element by attaching hooks of a fastening part in two adjacent pairs of slots 9, as will be described.

Figure 3:
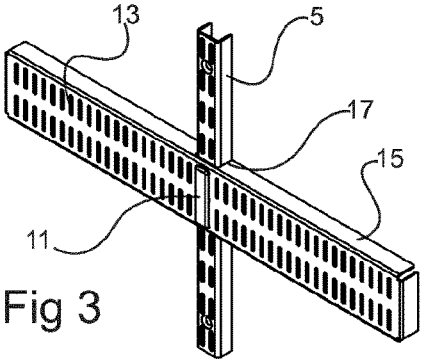
FIG. 3 shows a perspective view of the combination in FIG. 1.

In the illustrated case, the storage device is a slotted plate onto which in turn other storage devices such as hooks or tool holders, etc. can be attached. FIG. 3 shows a perspective view of the combination with the slotted plate 3. The plate can be formed as a single part with slots 13 punched therein, and the edges 15 of the plate being flanged towards the side of the carrier element. At least in the vicinity of where the hooks are located, the flanges may have a notch 17, where a carrier element 5 can be accommodated, as illustrated. The slots 13 of the storage device 3, and the slots 9 of the carrier part 5 may have the same shapes and configurations, such that four slots of the storage device and four slots of the carrier part can be aligned.

Figure 2:
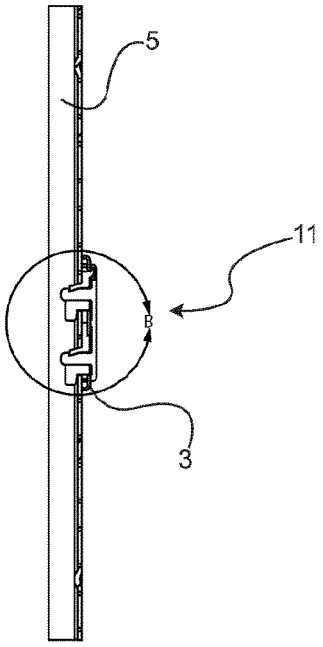
FIG. 2 shows a cross section along the line A-A in FIG. 1.
Figure 12:
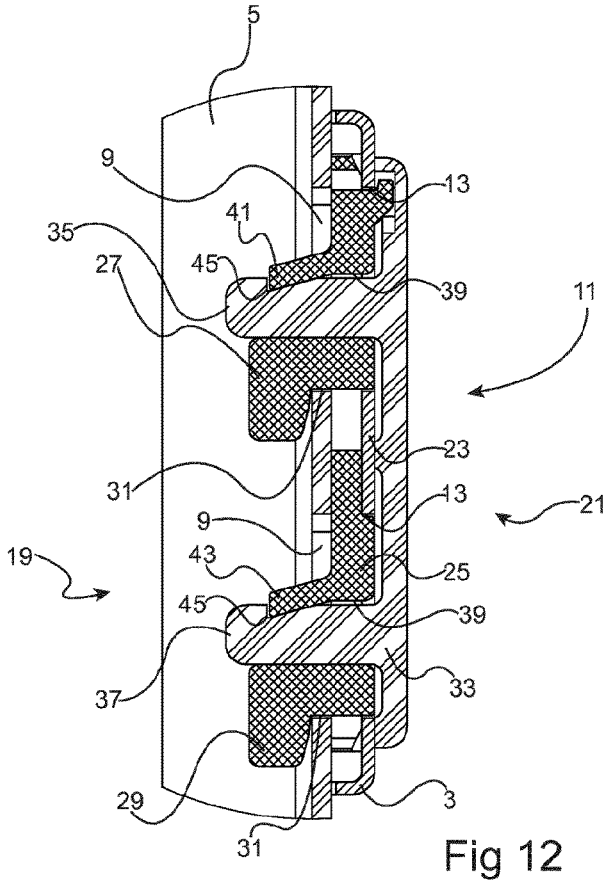
FIG. 12 shows an enlarged portion of the cross section in FIG. 2 illustrating an assembled fastening part attached to a carrier element.

FIG. 2 shows a cross section along the line A-A in FIG. 1. An enlarged portion B of this cross section with the fastening part 11 is shown in FIG. 12 to which reference now is made. The fastening part 11 has a carrier side 19 and an outer side 21. The fastening device 11 comprises a base portion 23, which in the illustrated case comprises a part of the slotted plate with four slots, an upper and a lower pair of slots 13. An inner part 25 rests on the base portion at the carrier side 19, and provides hooks, in the illustrated case four hooks of which two, one upper 27 and one lower 29 are shown in cross section. The hooks extend from the base portion 23, each into a slot 9 of the carrier element 5. A ledge 31 of each hook 27, 29 may rest on the lower edge of a carrier element slot 9 which takes up the load of the storage device 3 as a whole. In order to attach the inner part 25 to the base portion 23, an outer part 33 is provided. The outer part 33 rests on the base portion 23 at the outer side 21 thereof, and comprises a connector, in the illustrated cross section in the form of two protruding parts 35, 37 that each engage with the inner part 25 through an opening 13 of the base portion 23 and an opening 39 in the inner part, such that the base portion 23 becomes sandwiched between the inner 25 and outer 33 parts. The protruding parts 35, 37 of the outer part 33 may each comprise a flat bar that each reach through the opening 13 in the base portion 23, through an opening 39 in the inner part 25 and through the slot 9 of the carrier element 5. The protrusions 35, 37 can be locked in this position by tongues 41, 43 of the inner part 25 snapping into a recess 45 of each protrusion 35, 37.

To release the storage device from the carrier element 5, the storage device and the fastening device are forced upwards until the hooks 27, 29 are clear from the lower edges of the carrier part openings 9, and the hooks are pulled out of the carrier element.

Different means may optionally be considered to ensure that the parts are assembled with the correct orientation. For instance, it would be possible to provide a pin (not shown) on the carrier side of the outer part that can extend through corresponding openings in the base part and the inner part, but only if the parts are correctly oriented and aligned.

If the storage device 3 covers a significant number of slots 9 of the carrier element 5, it may be useful to utilise more than one fastening part to connect the storage device with the carrier element.

FIGS. 4-8 show different views of the fastening device inner part 25. A front view as seen from the carrier side is shown in FIG. 4 and a corresponding perspective view in FIG. 7A. The inner part may be formed in one piece by injection moulding plastic. Polyamide (PA) is one useful material, optionally reinforced with e.g. 30% glass fibre, even if other plastic materials are conceivable. In principle, other materials such as metal could be considered, even though production costs would likely be higher. As is most clearly shown in FIG. 7A, the inner part 25 as a whole may have a U-shaped cross section. The inner part thus has in cross-section two leg portions 30, 32 extending from a mid section 34 to form the U in cross section. The corresponding U shaped profile of the carrier element (cf. 5, FIG. 1) only just fits inside the U-shaped profile of the inner part. This means that, when attached, the inner part 25 straddles the carrier element tightly to provide an excellent, tight fit when the storage device is attached to the carrier. The leg portions 30, 32 may even be inclined slightly inwards to provide a tighter grip.

FIGS. 4 and 7A show the upper 27 and lower 29 hooks that extend from the mid section of the U shaped profile. Above each hook, an opening 39 is located to receive the protruding part of the outer part, mentioned before, and a tongue 41, 43 that locks the protruding part with a snap function. It should be noted that other configurations are possible.

FIGS. 5 and 8 show a front view and a perspective view of an inner part 25 as seen from the storage device (outer) side. Further, FIG. 6 shows a cross section along the line B-B in FIG. 5. Even if the storage device side of the inner part in principle could be flat save for the openings that receive the protruding parts of the outer part, it may be useful to allow the inner part to extend into the openings of the base part. In the illustrated case, projections 46 are provided that extend, about as much as the thickness of the base portion, from the storage device side of the inner part, such that they can enter the openings 13 of the base portion 23 (cf. FIG. 12). Those projections 46 are best seen in FIGS. 6 and 8 where they are indicated with dashed lines. As shown, the projections are configured to fill the openings of the base part except for where the openings 39 of the inner part are located. However, other configurations are possible.

One advantage with the illustrated configuration of the projections 46 is that the upper edges of the openings in the base part will rest on an outer ledge 47 of the inner part. In turn, the aforementioned hook ledge 31 of the of the inner part rests on the carrier element 5 when attached thereto. Therefore, the inner member 25 can more or less alone take up the entire load of the storage device. Additionally, as illustrated, a hook ledge may be connected to an outer hook 49 that reaches out to the storage device side of the base part in order to further fix the base part to the inner part.

The hooks 27, 29 as illustrated in FIG. 7A have a width that allows them to be inserted into the carrier element slots limiting their extensions laterally. As is clear from the cross section in FIG. 6 the hooks can be considerably thicker in the elongated direction of the slots which allows the hooks to take up a considerable load. FIG. 7B shows an enlarged portion of FIG. 7A illustrating integrated wedges 28 placed on the lateral sides of the hooks and tapering in the direction away from the inner part mid section 34. These wedges serve to mitigate any lateral play between the hooks and the slot openings in the carrier element 5, and need only cover a fraction of the hook height.

FIGS. 9-11 show the outer part 33, where FIG. 9 is a front view as seen from the carrier side, FIG. 10 is a cross section along the line C-C in FIG. 9, and FIG. 11 is a perspective view corresponding to FIG. 9. The outer part may be formed in one piece by injection moulding plastic. Polypropylene (PP) is one useful material, optionally reinforced with e.g. 20% glass fibre, even if other plastic materials are conceivable.

As shown, two upper 35 and two lower 37 protrusions extend from the base plane of the outer part 33, and each has a notch 45 where a tongue of the inner part can snap into engagement to lock the outer part 33 in place. The outer part may comprise recesses 51 to accommodate the aforementioned outer hook 49 of the inner part (cf FIG. 6).

As shown most clearly in FIG. 10, the outer part 33 may comprise slightly protruding contact surfaces 53 that are located at some distance from the upper 35 and lower 37 protrusions. This means that the protrusions, when locked by the tongues in the inner part, can be slightly pre-stressed such that the sandwiched package of the inner part, the base part and the outer part can be kept firmly together.

Figure 13:
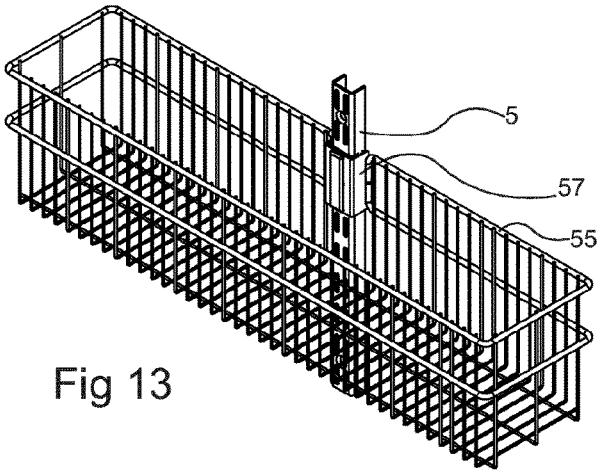
FIG. 13 shows a perspective view of another example of a combination.

FIG. 13 shows a perspective view of another example of a combination. In this combination, the storage device is a basket 55 made of metal wire. A plastic box could be formed in a similar shape. As shown, the basket is provided with a fastening device 57 that is inserted inside the outer periphery of the basket. This means that the basket itself may rest against the surface that the vertical carrier element 5 is attached to, which provides for a better lateral stability. Further, the base part of the fastening device 57 may be formed in sheet metal with a U-shaped cross section which straddles the carrier element as well as the inner part of the fastening device when the storage device is attached to the carrier element. This provides for an even more stable arrangement.

The present disclosure is not restricted to the above-described embodiments, and may be altered in various ways within the scope of the appended claims. For instance, other plastic materials such as e.g. ABS or polycarbonate, PC, may be considered for the inner and outer parts.

The invention claimed is:

1. A fastening part for a storage system, the fastening part being attached to a storage device, and being adapted to be attached, at a carrier side, to a vertical carrier element with a number of slots, wherein the fastening part comprises base portion, and at least one hook extending from the base portion at the carrier side and being intended to be inserted into one such slot, comprising at least one opening in said base portion, an inner part resting on the base portion at said carrier side, and providing said at least one hook, and an outer part resting on the base portion at an outer side, and comprising a connector that engages with said inner part through said at least one opening, such that the base portion is sandwiched between the inner part and the outer part.

2. A fastening device according to claim 1, wherein the inner part comprises, on the outer side, projections that extend from the inner part, such that they can enter the openings of the base portion.

3. A fastening device according to claim 2, wherein the projections include a ledge, on which an upper edge of a base part opening can rest, and an outer hook that reaches out to the storage device side of the base part.

4. A fastening device according to claim 1, wherein a connector includes a recess, and the inner part comprises a tongue adapted to snap into said recess in order to keep the inner and outer parts locked together.

5. A fastening device according to claim 1, wherein the inner part comprises an upper and a lower pair of hooks.

6. A fastening device according to claim 1, wherein the inner and outer parts are made in injection molded plastic.

7. A fastening device according to claim 1, further comprising a first and a second leg portion extending towards the carrier side from a mid section of the inner part, such that the fastening device has a U-shaped cross section for straddling a U-shaped carrier element when attached thereto.

8. A fastening device according to claim 7, wherein the inner part comprises, on the outer side, projections that extend, from the inner part, such that they can enter the openings of the base portion.

9. A fastening device according to claim 8, wherein the projections include a ledge, on which an upper edge of a base part opening can rest, and an outer hook that reaches out to a storage device side of the base part.

10. A fastening device according to claim 7, wherein a connector includes a recess, and the inner part comprises a tongue adapted to snap into said recess in order to keep the inner and outer parts locked together.

11. A fastening device according to claim 7, wherein the inner part comprises an upper and a lower pair of hooks.

12. A fastening device according to claim 7, wherein the inner and outer parts are made in injection moulded plastic.

13. A fastening device according to claim 1, wherein the storage device is comprised of a slotted plate comprising a number of slots and the base portion is integrated in one piece with said plate.

14. A fastening device according to claim 13, wherein edges of said plate are flanged towards the carrier side of the fastening device, and where at least in the vicinity of the fastening device, the flanges comprises a notch, such that a carrier element can be accommodated in the notch.

15. A fastening device according to claim 13, wherein the inner part comprises, on the outer side, projections that extend, from the inner part, such that they can enter the openings of the base portion.

16. A fastening device according to claim 15, wherein the projections include a ledge, on which the upper edge of a base part opening can rest, and an outer hook that reaches out to the storage device side of the base part.

17. A fastening device according to claim 13, wherein a connector includes a recess, and the inner part comprises a tongue adapted to snap into said recess in order to keep the inner and outer parts locked together.

18. A fastening device according to claim 13, wherein the inner part comprises an upper and a lower pair of hooks.

19. A fastening device according to claim 13, wherein the inner and outer parts are made in injection molded plastic.

20. A fastening device according to claim 1, wherein the storage device is a box or basket and is provided with a fastening device that is inserted inside the outer periphery of the box or basket.

21. A fastening device according to claim 20, wherein the inner part comprises, on the outer side, projections that extend, from the inner part, such that they can enter the openings of the base portion.

22. A fastening device according to claim 21, wherein the projections include a ledge, on which the upper edge of a base part opening can rest, and an outer hook that reaches out to the storage device side of the base part.

23. A fastening device according to claim 20, wherein a connector includes a recess, and the inner part comprises a tongue adapted to snap into said recess in order to keep the inner and outer parts locked together.

24. A fastening device according to claim 20, wherein the inner part comprises an upper and a lower pair of hooks.

25. A fastening device according to claim 20, wherein the inner and outer parts are made in injection molded plastic.

* * * * *